United States Patent [19]

Kraszewski et al.

[11] 4,261,609

[45] Apr. 14, 1981

[54] INGOT GRAB APPARATUS

[75] Inventors: Eugene Kraszewski; George V. Wisnauiskas, both of Salem, Ill.

[73] Assignee: Acco Industries Inc., Trumbull, Conn.

[21] Appl. No.: 77,020

[22] Filed: Sep. 19, 1979

[51] Int. Cl.[3] ..... B66C 1/10

[52] U.S. Cl. ..... 294/86 R; 294/67 BB; 414/621; 414/729; 414/741

[58] Field of Search ..... 294/86 R, 85, 67 B, 294/67 BB, 67 BC, 67 DC, 96, 102 R, 110 B, 116; 414/621, 635, 729, 741, 742

[56] References Cited

U.S. PATENT DOCUMENTS 2,347,922 5/1944 Nelson ..... 294/86 R 2,959,445 11/1960 Breslav ..... 294/67 BB

*Primary Examiner*—James B. Marbert

*Attorney, Agent, or Firm*—Barnes, Kisselle, Raisch & Choate

[57] ABSTRACT

An ingot grab apparatus comprising a pair of grab legs supported for general horizontal movement toward and away from one another. A grip point is associated with each leg and is mounted on its respective leg for movement along an incline extending downwardly and inwardly and upwardly and outwardly. The grip points generally face one another for engagement with the side surfaces of an ingot such that when the legs are moved toward one another to engage an ingot and the carrier is elevated, the grip points are forced downwardly and inwardly into the ingot.

8 Claims, 8 Drawing Figures

14
19
10
12
18
16
41
17
11
13
15
I
20
20
14

15
38
5
39
4
20d
20a
35
14
27
25
31
26
4
24
29
37
36
23
21
28
30
20
22
5

INGOT GRAB APPARATUS

This invention relates to ingot grab apparatus.

BACKGROUND AND SUMMARY OF THE INVENTION

In the handling of ingots or billets of metal, ingot grab apparatus is commonly utilized to lift the ingot or billet vertically from a mold and then transport it and lay it down in a horizontal position. In one type of ingot grab apparatus, grip points are provided that are brought toward the ingot or billet to engage the sides thereof so that it can be lifted.

Among the objectives of the present invention are to provide an ingot grab apparatus which will safely handle metal ingots and billets, wherein the gripping force increases as the billet is lifted, and which will automatically release the ingot or billet as desired.

In accordance with the invention, a carrier is provided having a pair of legs movable toward and away from one another. Each leg supports a grip point that is mounted so that it is movable downwardly and inwardly to produce a wedging action so that when the point engages an ingot and the carrier for the legs is elevated by the associated hoist, the grip points penetrate the ingot, further insuring a positive engagement with the ingot. The apparatus further includes means associated with each point to lock it in gripping position after it has moved downwardly and inwardly toward the ingot and means for automatically releasing the grip point only when the legs are moved outwardly on the carrier to their outermost position.

DESCRIPTION

Figure 1:
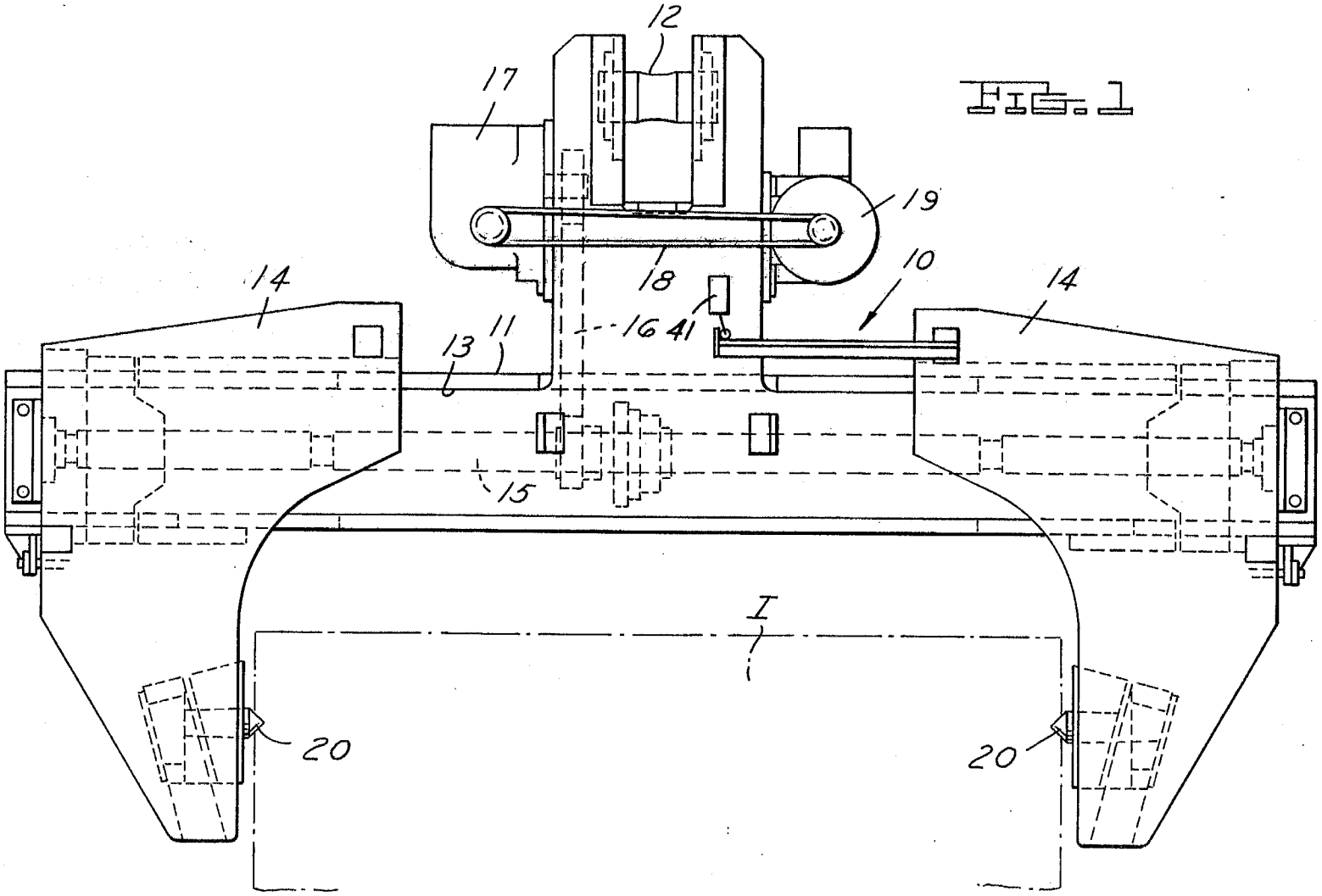
FIG. 1 is a side elevational view of an ingot grab apparatus embodying the invention.

Referring to FIG. 1, the ingot grab apparatus 10 embodying the invention comprises a carier 11 having a cross pin 13 for attachment to the hook of a hoist or the like. The carrier 11 includes a slide track 13 along which grab legs 14 are adapted to be moved by a screw 15 that is journalled on the carrier 11. The screw 15 has opposed threads that engage nuts on the legs 14. The screw 15 is driven by a chain 16 through a gearbox 17 and endless chain 18 from a motor 19 so that when the screw 15 is rotated in one direction, the legs 14 are moved inwardly toward one another, and when the screw is rotated in the opposite direction, the legs are moved outwardly away from one another. Each leg 14 supports a grip point 20, as presently described, so that as the legs 14 are moved toward one another after the carrier is brought into position, the points 20 will engage the sides of a metal ingot or billet I.

Figure 2:
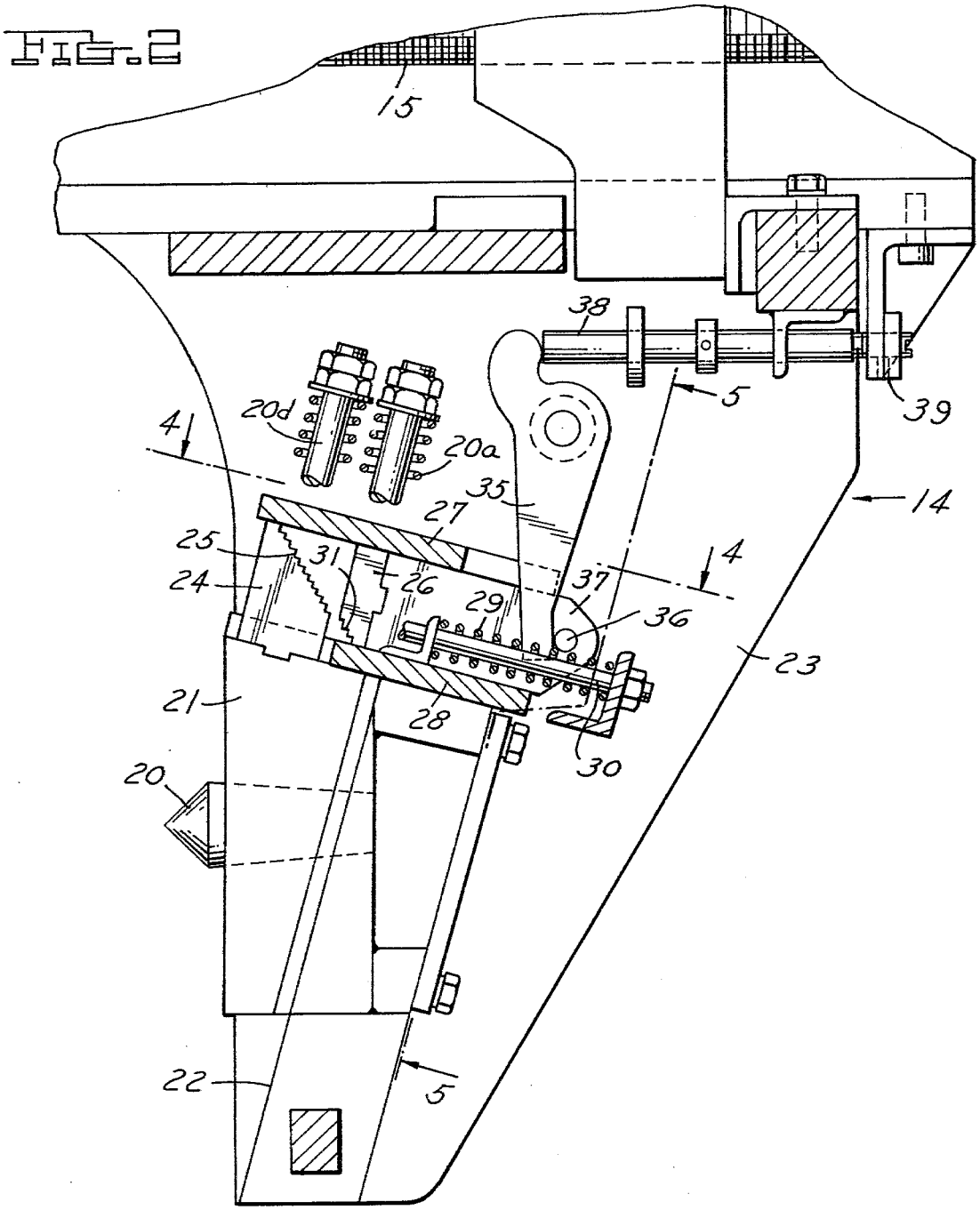
FIG. 2 is a vertical sectional view through a portion of the apparatus on an enlarged scale.
Figure 4:
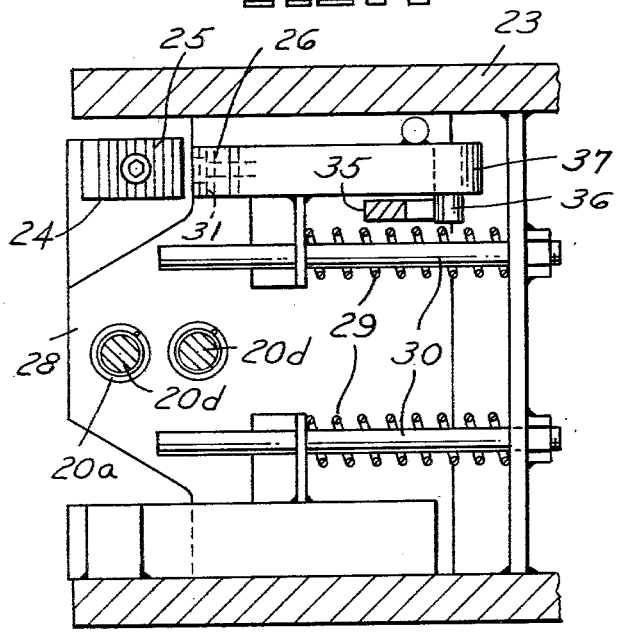
FIG. 4 is a fragmentary sectional view taken along the line 4—4 in FIG. 2.
Figure 5:
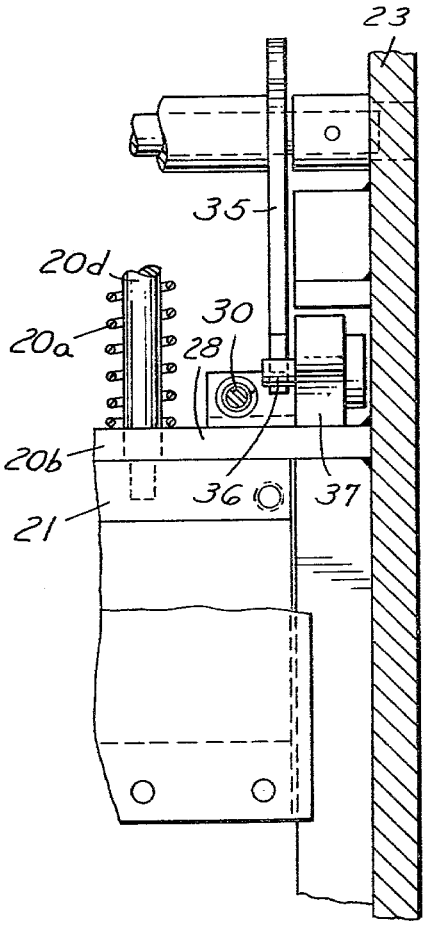
FIG. 5 is a fragmentary sectional view taken along the line 5—5 in FIG. 2.

Referring to FIG. 2, each ingot point 20 is mounted on a wedge block 21 that is slidable on spaced wedge tracks 22 extending downwardly and inwardly and upwardly and outwardly between the plates 23 of the leg 14. By this arrangement, when the legs 14 are brought together, the points 20 engage the billet, and when the carrier 11 is then raised by a hoist, the points 20 move downwardly and inwardly penetrating the ingot I further to firmly engage the ingot. Each point 20 is yieldingly urged upwardly by springs **20*a* interposed between a portion 20*b* of leg 14 and nuts 20*c* on rods 20*d* fixed on wedge block 21 (FIGS. 4, 5**).

In order to prevent inadvertent disengagement, means is provided which includes a lock member 24 having horizontally extending teeth 25. An interengaging member 26 is slidable between plates 27, 28 on the leg 14 and yieldingly urged inwardly by springs 29 on rods 30 so that when the wedge block 21 moves downwardly, the member 26 having teeth 31 thereon engages the teeth 25 of the lock member 24 to prevent upward movement of the wedge block 21 and, in turn, the grip point 20.

Figure 3:
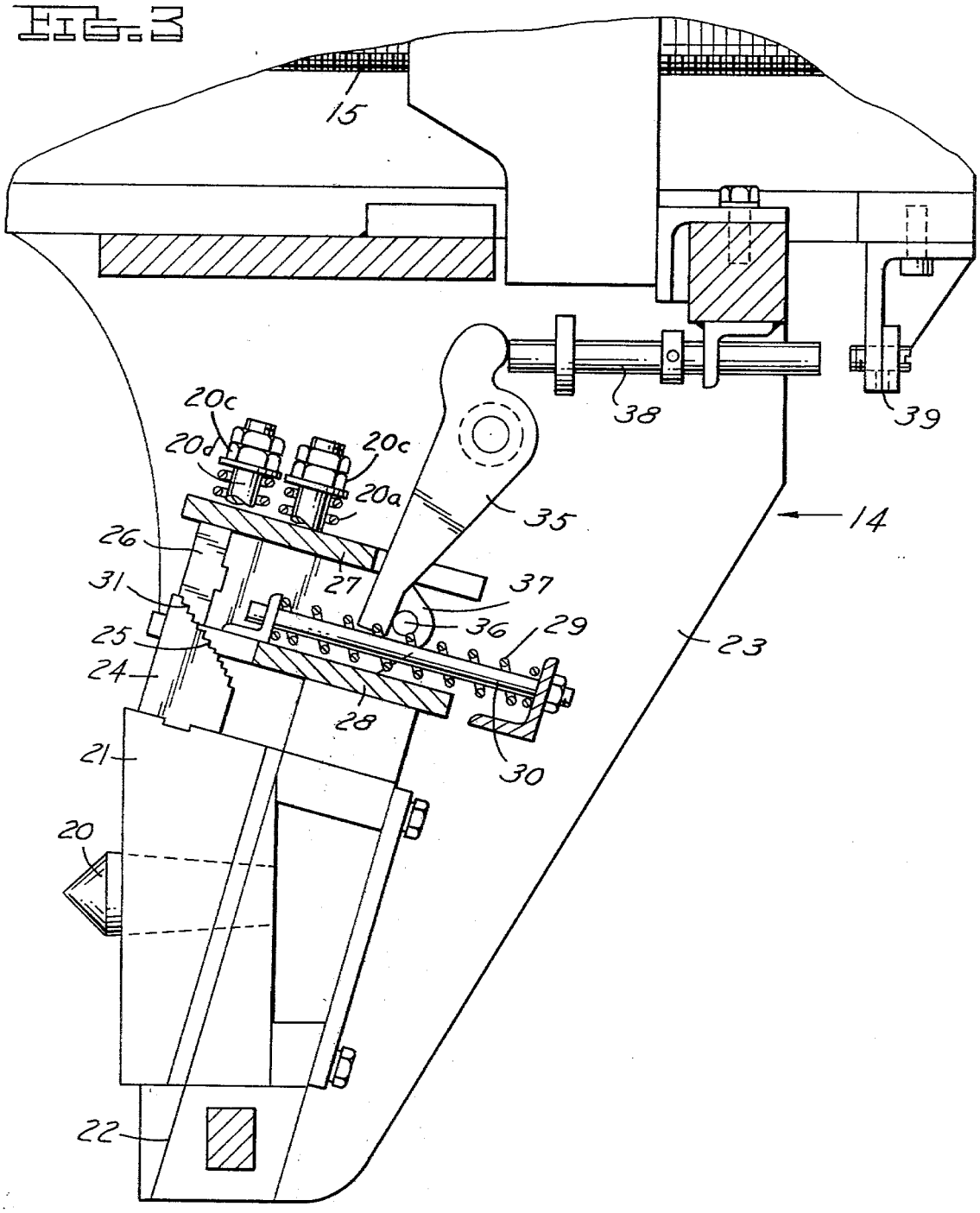
FIG. 3 is a vertical sectional view similar to FIG. 2 showing the parts in a different operative position.
Figure 8:
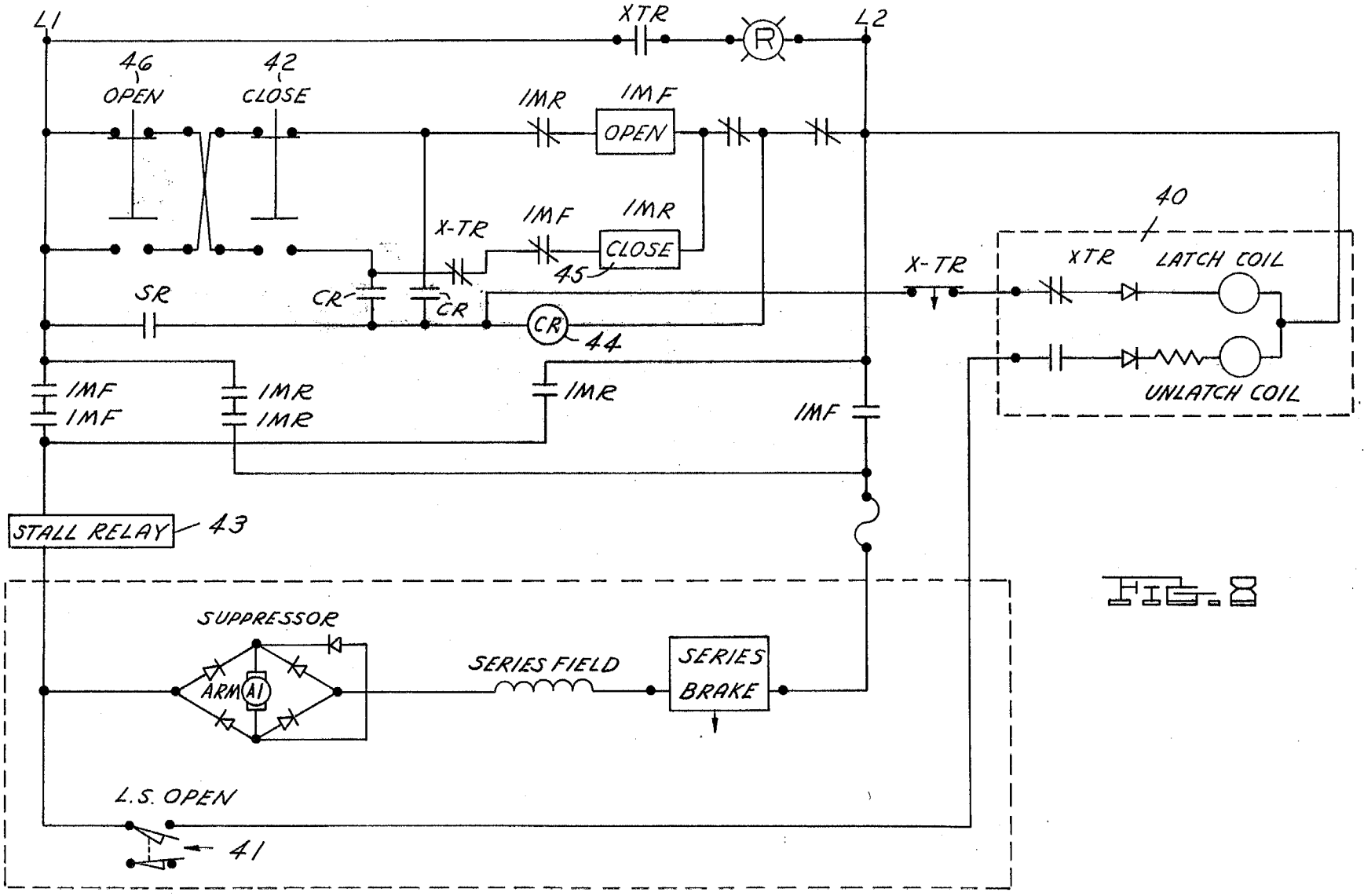
FIG. 8 is a schematic wiring diagram of the control system for the ingot grab apparatus.

In accordance with the invention, disengagement of the interengaging member 26 from the lock member 24 occurs only when the legs 14 have been moved outwardly on the carrier to their outermost position. As shown in FIGS. 3–5, this is achieved by a lever 35 that has its lower end adapted to engage a pin 36 on the operator 37 of the interengaging member 26 and its upper end adapted to engage a rod 38 on the carrier so that when the legs are moved to the outermost position on the carrier, the engagement with the rod retracts the interengaging member 26. The position of rod 38 is adjustable by a thread thereon which engages a fixed nut 39. FIG. 8 is a schematic wiring diagram of the control circuit for the grab apparatus and can be more readily understood by reference to a typical cycle of operation.

Initially, the grab apparatus is in the open position and the points 20 are spaced apart. The X-TR permanent magnet latch relay 40 off-delay timing will be in the unlatch condition. The L.S. open limit switch 41 normally open contact will be tripped open. With the grab apparatus positioned over the ingot for attaching:

1. The operator will press and hold pressed the close pushbutton 42. The grab apparatus will run closing the points 20 on the ingot.
2. When the points 20 make contact with the ingot, the motor will stall.
3. With the motor stalled, the stall relay 43 normally open contacts will close which, in turn, energizes CR relay 44 and X-TR timer relay 40.
4. The CR normally closed contact will open and de-energize the 1MR close motor starter coil 45, de-energizing the motor. The X-TR instantaneous normally closed contact will open inhibiting closing. X-TR instantaneous normally open contact will close illuminating the red pilot light.
5. Normally closed X-TR timer will be instantaneously opened.

To open the grab apparatus with the ingot positioned in contact with the ground:

1. The operator will press and hold pressed the open pushbutton 46, the grab apparatus will run moving the points away from the ingot.
2. After the points 20 are moved to their outermost position, the cam limit switch 41 energizes the unlatch coil of the X-TR permanent magnet latch relay 40.

3. When the red pilot is de-energized, the circuit has been reset and the operator must release the open pushbutton 46.

The ingot grab apparatus embodying the invention may be used to lift ingots or billets in a vertical position and lay them down to a horizontal position. This is done by resting the bottom end of an ingot or billet on the floor and moving the hoist forward and down.

In a typical cycle of operation, the grab apparatus with the grab legs spaced apart or open is placed on the top of the ingot. The motor driven screw moves the grab legs inward and engages the ingot. When the hoist hook is raised, the grip wedge assembly with points will move down and in at a set angle applying pressure in proportion to the load being lifted. The downward movement of the grip wedge assembly creates a gap in the lock that is being closed by a spring actuated plunger.

This continuous engagement of the lock in overchanging positions of the grip wedge assembly prevents the upward motion of the gripping points. In this locked up position, the operator will be able to handle the ingot safely lifitng it up, resting the end on the floor, maneuvering it to a desired position and laying it down.

To disengage the grab from the load, the motor driven screw is reversed and the legs are moved outward to an open position engaging the end stops. Upon engaging the end stop, the actuating rod by pushing on the lever retracts the plunger from lock. With plunger retracted clear of lock, grip wedge assembly is raised up by the wedge springs to its original position. The grab is ready to start another cycle.

In order to avoid engaging the load when the grip wedge assembly is in the down (locked) position, a limit switch and a permanent magnet latch relay are added to the standard control circuit. With this circuit control, the operator cannot close the grab accidentally without unlocking the grip wedge assembly with the gripping point.

The advantages of the wedge lock on an ingot lifter require a review of the wedge grip action.

Figure 6:
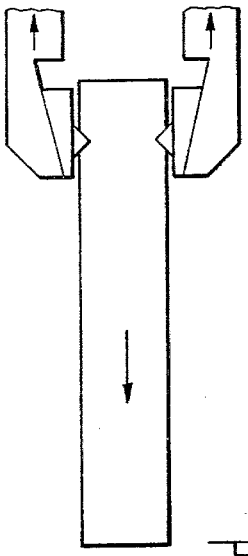
FIGS. 6 and 7 are diagrammatic views showing the apparatus in different operative positions.

Referring to FIG. 6 showing the grab with ingot, as the grab raises the ingot, the grip points engaged in the ingot pull the wedges down forcing the points deeper into the ingot. This deep penetration prevents the ingot material from tearing out above the points. The ingot can then be transported safely.

Figure 7:
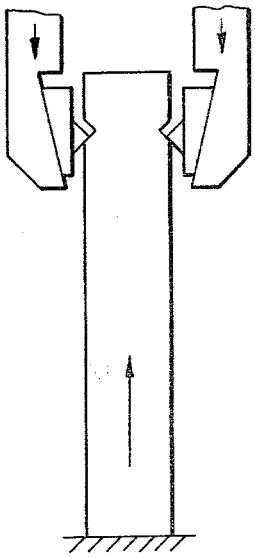

Referring to FIG. 7, when the grab is lowered and the ingot strikes the floor, the wedges will be pushed upward relative to the grab thus retracting the grip points out of the ingot.

The ingot grabs are primarily used to pull ingots out of the vertical molds and then deposit them horizontally on racks and conveyors.

The crane operator manipulates the grab to abut the lower part of the ingot against a storage rack and then lowers the grab while maintaining contact between ingot and rack. As long as the operator can maintain a freely hanging load on the grab, he can deposit an ingot properly.

With prior grab apparatus, when the operator accidentally lowers the ingot into contact with the floor, the apparent motion of the ingot with respect to the grab apparatus is upward which allows the wedges to move up retracting the grip points from the ingot as in FIG. 7. This momentary loss of load on the wedges allows the wedge pull-back springs to snap the wedges upward. This creates a good possibility for dropping an ingot which is a distinct hazard.

The use of the wedge lock mechanism lessens the demands on the grab operator's skill and judgment, making the handling of ingots a safer operation.

As described, the wedge lock mechanism prevents the wedges from moving upward. The grip points remain embedded in the ingot at all times. The ingot can be released only by opening the grab legs.

We claim:

1. An ingot grab apparatus comprising a pair of grab legs, means for supporting said legs for horizontal movement toward and away from one another, a grip point associated with each said leg, means for mounting each grip point on its respective leg for movement along an incline extending downwardly and inwardly and upwardly and outwardly, the grip points generally facing one another for engagement with the side surfaces of an ingot, such that when the legs are moved toward one another to engage an ingot and the carrier is elevated, said points are forced downwardly and inwardly into the ingot, lock means operable to prevent upward movement of said points after they have engaged said ingot, said last-mentioned means comprising a lock member associated with each said grip point, an interengaging member adapted to engage said lock member and prevent upward movement of said lock member, and means operable when said legs are moved outwardly to disengage said lock means.

2. The apparatus set forth in claim 1 wherein said means operable to disengage said lock means are effective only when said legs have moved outwardly to their outermost position.

3. An ingot grab apparatus comprising a pair of grab legs, means for supporting said legs for horizontal movement toward and away from one another, a grip point associated with each said leg, means for mounting each grip point on its respective leg for movement along an incline extending downwardly and inwardly and upwardly and outwardly, the grip points generally facing one another for engagement with the side surfaces of an ingot, such that when the legs are moved toward one another to engage an ingot and the carrier is elevated, said points are forced downwardly and inwardly into the ingot, lock means operable to prevent upward movement of said points after they engaged said ingot, said last-mentioned means comprising a lock member movable with each said grip point, an interengaging member adapted to engage said lock member and prevent upward movement of said lock member, said lock member having a plurality of horizontally extending teeth, said interengaging member comprising a member having teeth for engaging the teeth of said lock member, and means yieldingly urging said interengaging member toward said lock member, means yieldingly urging each said grip point upwardly, means operable when each leg is moved to its outermost horizontal position for retracting said interengaging member against the action of said yielding means to disengage said lock member.

4. The apparatus set forth in claim 3 wherein said last-mentioned means comprises a lever pivoted to each said leg, said lever having one end thereof adapted to engage said interengaging member, said lever having the other end thereof adapted to engage a rod mounted on said carrier adjacent each end of said carrier such that when said leg is moved outwardly, the other end of said lever engages said rod and thereby retracts said interengaging member.

5. The apparatus set forth in claim 4 including means for adjusting the position of said rod.

6. An ingot grab apparatus comprising a pair of grab legs, means for supporting said legs for horizontal movement toward and away from one another, a grip point associated with each said leg, means for mounting each grip point on its respective leg for movement along an incline extending downwardly and inwardly and upwardly and outwardly, the grip points generally facing one another for engagement with the side surfaces of an ingot, such that when the legs are moved toward one another to engage an ingot and the carrier is elevated, said points are forced downwardly and inwardly into the ingot, lock means operable to prevent upward movement of said points after they have engaged said ingot, said last-mentioned means comprising a lock member associated with each said grip point, an interengaging member adapted to engage said lock member and prevent upward movement of said lock member, said lock member having a plurality of horizontally extending teeth, said interengaging member having teeth for engaging the teeth of said lock member, and means yieldingly urging said interengaging member toward said lock member, means yieldingly urging said grip point upwardly, means operable when each leg is moved to its outermost horizontal position for retracting said interengaging member against the action of said yielding means to disengage said lock member.

7. The apparatus set forth in claim 6 wherein said last-mentioned means comprises a lever pivoted to each said leg, said lever having one end thereof adapted to engage said interengaging member, said lever having the other end thereof adapted to engage a rod mounted on said carrier adjacent each end of said carrier such that when said leg is moved outwardly, the other end of said lever engages said rod and thereby retracts said interengaging member.

8. The apparatus set forth in claim 7 including means for adjusting the position of said rod.

* * * * *